US007637378B2

(12) United States Patent
Malmberg

(10) Patent No.: US 7,637,378 B2
(45) Date of Patent: Dec. 29, 2009

(54) SCREENING DECK FOR FRACTIONATING CRUSHED STONE

(75) Inventor: Mats Malmberg, Rydsgard (SE)

(73) Assignee: Sandvik Intellectual Property AB, Sandviken (SE)

( * ) Notice: Subject to any disclaimer, the term of this patent is extended or adjusted under 35 U.S.C. 154(b) by 494 days.

(21) Appl. No.: 11/056,364

(22) Filed: Feb. 14, 2005

(65) Prior Publication Data

US 2005/0189265 A1 Sep. 1, 2005

(30) Foreign Application Priority Data

Feb. 13, 2004 (SE) ..... 0400337

(51) Int. Cl.
*B07B 1/49* (2006.01)

(52) U.S. Cl. ..... 209/392; 209/314; 209/354; 209/397; 209/400

(58) Field of Classification Search ..... 209/314, 209/354, 397, 392, 400
See application file for complete search history.

(56) References Cited

U.S. PATENT DOCUMENTS

| | | | | |
|---|---|---|---|---|
| 1,212,151 | A * | 1/1917 | Edmonds | 209/397 |
| 2,703,649 | A * | 3/1955 | Cheyette | 209/314 |
| 4,882,044 | A * | 11/1989 | Freissle | 209/319 |
| 4,913,804 | A * | 4/1990 | Muller | 209/44.2 |
| 5,085,324 | A | 2/1992 | Dehlén | |
| 5,346,053 | A | 9/1994 | Dorn | |
| 5,699,918 | A | 12/1997 | Dunn | |
| 5,769,241 | A * | 6/1998 | Woodgate | 209/399 |
| 6,607,080 | B2 * | 8/2003 | Winkler et al. | 209/399 |
| 6,736,271 | B1 * | 5/2004 | Hall | 209/409 |
| 2002/0056668 | A1 * | 5/2002 | Dube et al. | 209/421 |
| 2005/0167341 | A1 * | 8/2005 | Bacho et al. | 209/405 |
| 2006/0037891 | A1 * | 2/2006 | Lilie et al. | 209/397 |

FOREIGN PATENT DOCUMENTS

| | | |
|---|---|---|
| DE | 27 54 044 | 4/1979 |
| WO | WO 00/53343 | 9/2000 |
| WO | WO 03/057376 | 7/2003 |

* cited by examiner

*Primary Examiner*—Patrick H Mackey
*Assistant Examiner*—Kalyanavenkateshware Kumar
(74) *Attorney, Agent, or Firm*—Drinker Biddle & Reath LLP

(57) ABSTRACT

A screening deck for the screening of crushed stone material includes a plurality of screening elements arranged adjacent one another. At least one side of each screening element is non-parallel with respect to a longitudinal direction of the screening deck. The screening deck includes at least two different types of screening elements which are arranged at different heights in the screening deck for creating narrowing passages and/or winding paths and/or steps for the material traveling on the screening deck.

23 Claims, 7 Drawing Sheets

SCREENING DECK FOR FRACTIONATING CRUSHED STONE

The present application claims priority under 35 U.S.C. § 119 to Patent Application Serial No. 0400337-2 filed in Sweden on Feb. 13, 2004.

BACKGROUND OF THE INVENTION

The present invention relates to a screening deck for the screening of material, such as crushed stone, gravel or the like, that will herein be referred to as crushed stone, which expression is not intended to imply that the stone or gravel is of a particular size. The screening deck comprises screening elements through which the material falls.

In the mining and stone industries, it is in many cases important to fractionate (separate) crushed stone and gravel into fractions of different sizes. Ideally, each fraction would comprise particles of a prescribed size, but in practice each fraction typically includes particles that are somewhat larger or smaller than the prescribed size. Normally, the deviation from the prescribed size that is permitted according to industry standards is defined, e.g., 10 percent for oversized particles and 15 percent for undersized particles. It is, however, important that each fraction comprises a blend of particles within the permitted deviation range, since mixtures that deviate from the standard blends are prized lower.

In most cases, fractionating is done by supplying an unfractionated stream of crushed stone or gravel to a vibrating screen provided with screening elements including screening holes for allowing stones smaller than the screening holes to pass through the holes. The vibration pattern and the inclination of the vibrating screen are arranged so that the crushed stones continuously flow in one direction on the screen, ultimately exiting one side of the screen or falling through the holes in the screening elements.

In this way it is possible to fractionate the crushed stone stream into stones smaller than the screening holes and stones larger than the screening holes. For most applications, such a fractionating is not sufficient, since the resulting crushed stone fractions range in size from stone powder up to the screening hole size and from the screening hole size up to the largest stones entering the screen, respectively. One way of further fractionating the crushed stone into finer fractions is to run one fraction leaving the screen to a further screen, but a more common way of solving the problem is to use a screen with multiple screening decks on top of each other.

On a screen with multiple screening decks, the screening decks are provided with ever smaller screening holes the lower the deck is located. Due to gravity, stones smaller than the screening holes in an upper deck will fall down to the neighboring lower deck. Stones smaller than the screening holes in that deck will fall through the screening holes, either to a further lower deck or to a surface below the lowermost screening deck. Hence, as the crushed stones leave the screen, the fraction between two decks will contain stones ranging in size from larger than the hole size of the lower screening deck to smaller than the hole size of the upper screening deck.

A problem with screening decks is the wear which they undergo. As is well known by people skilled in the art, crushed stones are very abrasive, especially when they are vibrated in order to flow slowly over a screen. In order to reduce the wear, virtually all surfaces contacting the crushed stone can be clad with, or made of, rubber or polyurethane. The areas most exposed to wear are the edges of the screening holes. Hence, most screening decks are provided with exchangeable screening elements. This not only allows exchange due to worn elements, but also for exchange between screening elements of various screening hole sizes.

A system for exchanging screening elements in a vibrating screen for the screening of crushed rocks or gravel is described in SE-A-0 460 340 (corresponding to U.S. Pat. No. 5,085,324). The screen according to that invention includes a multitude of screening elements. The elements are at one end provided with snap locks for interaction with elongated stanchions provided on transverse carriers reaching across the screen. The other ends of the screening elements that are not provided with snap locks are jammed in place by means of an extension of a neighboring screen element.

One major problem with all screening decks is that the crushed stone material to be screened, i.e. stones or gravel, travel along a longitudinal path in the screening deck. The travel path of the material is also called the traveling direction. At the edges of the screening elements, there are no screening holes. Hence, the longitudinal connection area between two adjacent screening elements is not provided with holes. This means that if the material starts to travel close to the edges of the screening element, where no holes are placed, the material may travel over the entire length of the screening deck without encountering a screening hole. This problem is worsened by the fact that the screening elements are rectangular or square having symmetrically located holes, thus creating longitudinal paths without holes. One way of decreasing this problem has been to provide wedge-shaped obstacles on the screening element or on the edges of the screening elements that cause the material to change direction or at least move it transversely to the traveling direction.

Further, it is important that the material to be screened does not move so quickly and undistorted over the screening element that the material that should fall down through the holes has the possibility to pass over the holes.

SUMMARY OF THE INVENTION

The above-mentioned shortcomings and/or other problems are solved in that at least one side of each screening element is non-parallel with respect to a longitudinal direction of the screening deck; that the screening deck includes at least two different types of said screening elements; and that different screening elements are arranged at different heights in the screening deck for creating narrowing passages or winding paths for the material on the screening deck.

BRIEF DESCRIPTION OF THE DRAWINGS

In the following, a preferred embodiment of the invention will be explained with reference to the accompanying drawings.

DESCRIPTION OF PREFERRED EMBODIMENTS

Figure 1:
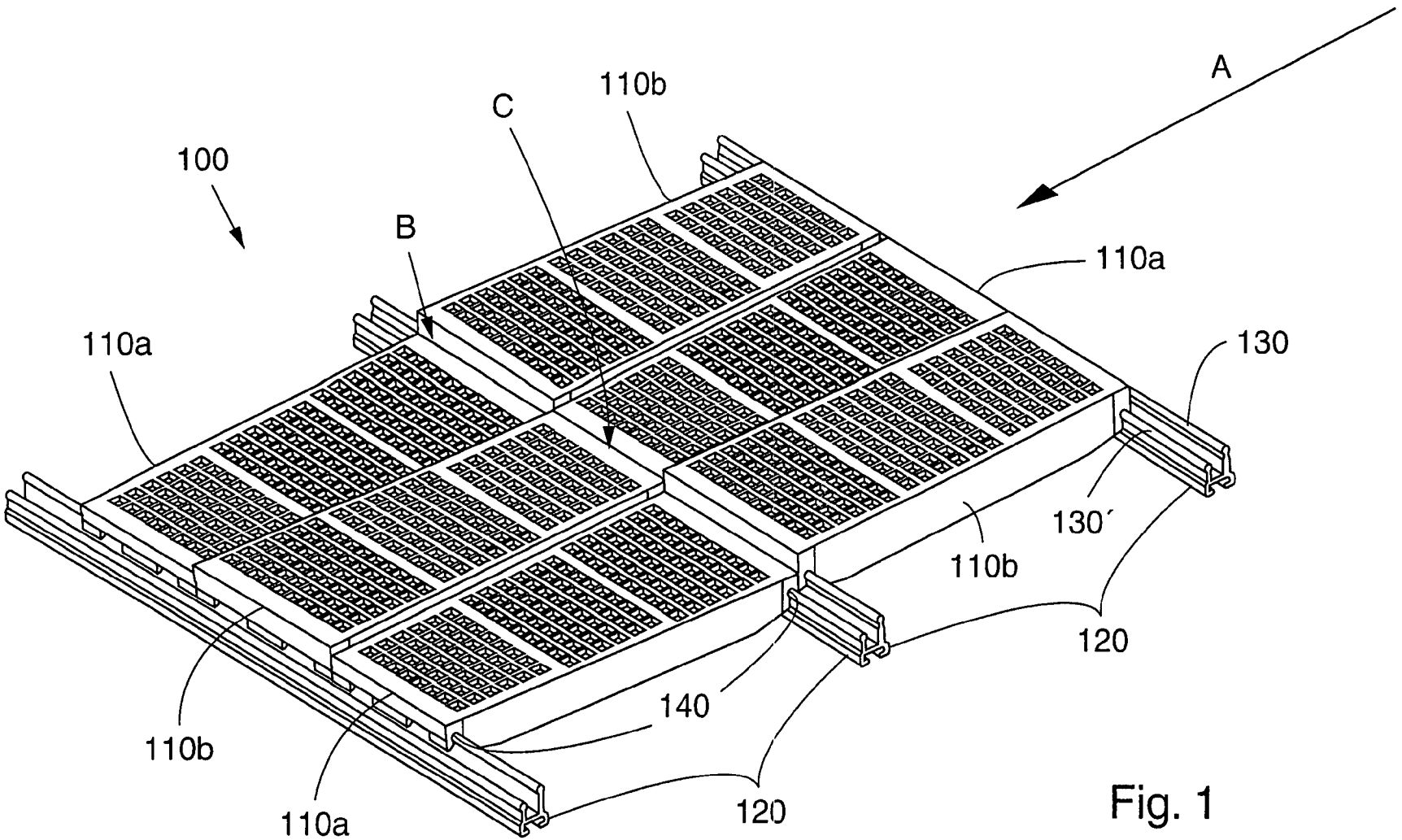
FIG. 1 is a schematic perspective assembly view of a screening deck according to a first embodiment of the present invention.

FIG. 1 schematically shows a screening deck 100 for the screening of crushed stone. As used herein the expression "crushed stone" includes stone, gravel, and the like that has been crushed to any suitable size. The screening deck comprises three short screening elements 110*a*, three tall screening elements 110*b* and three transverse carriers 120. The screening elements 110*a* and 110*b* differ in height, but otherwise they have a substantially identical shape. In FIG. 1 the top surface of screening element 110*a* is lower than that of screening element 110*b*. The screening elements 110*a* and 110*b* are normally alternately placed so that the neighboring screen element always will be of the other type. Each carrier 120 includes two elongated stanchions 130, 130', extending parallel to the other carriers 120.

Figure 2:
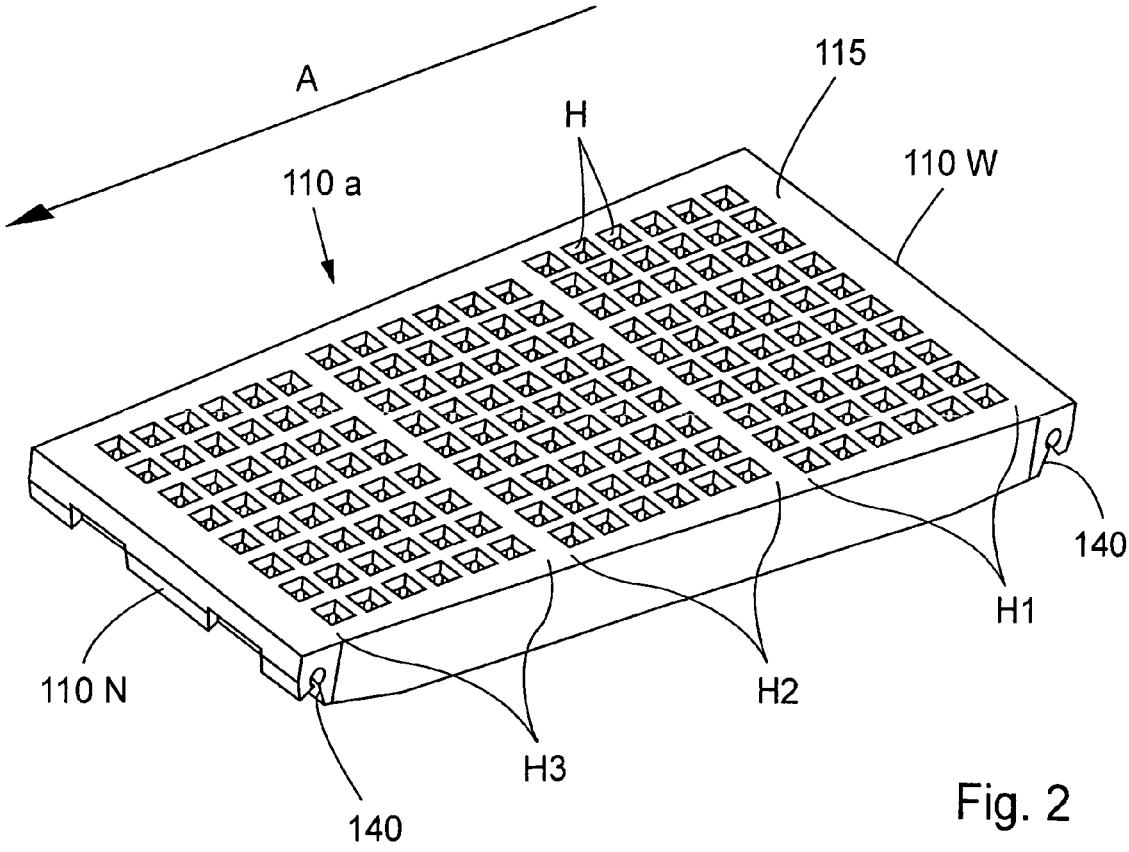
FIG. 2 is a perspective view of a screening element according to the present invention.

A longitudinal direction of the screening deck is indicated with an arrow A in FIG. 1. The longitudinal direction of the screening deck is also the traveling direction for the crushed stone material in the vibrating screen. As shown especially well in FIG. 2, each screening element 110*a* is provided with snap locks 140 at its underside. The snap locks interact with the elongated stanchions 130, 130' for fastening the screening element to the transverse carriers 120. FIG. 2 shows a larger-scale perspective view of the screening element 110*a* including the snap locks 140. Through holes H have been provided in a screening membrane 115 for fractionating the crushed stone into fractions of stones or gravel of different sizes. The screening element 110*b* is substantially similar to the screening element 110*a*, except for the difference in height, as noted earlier.

Figure 3:
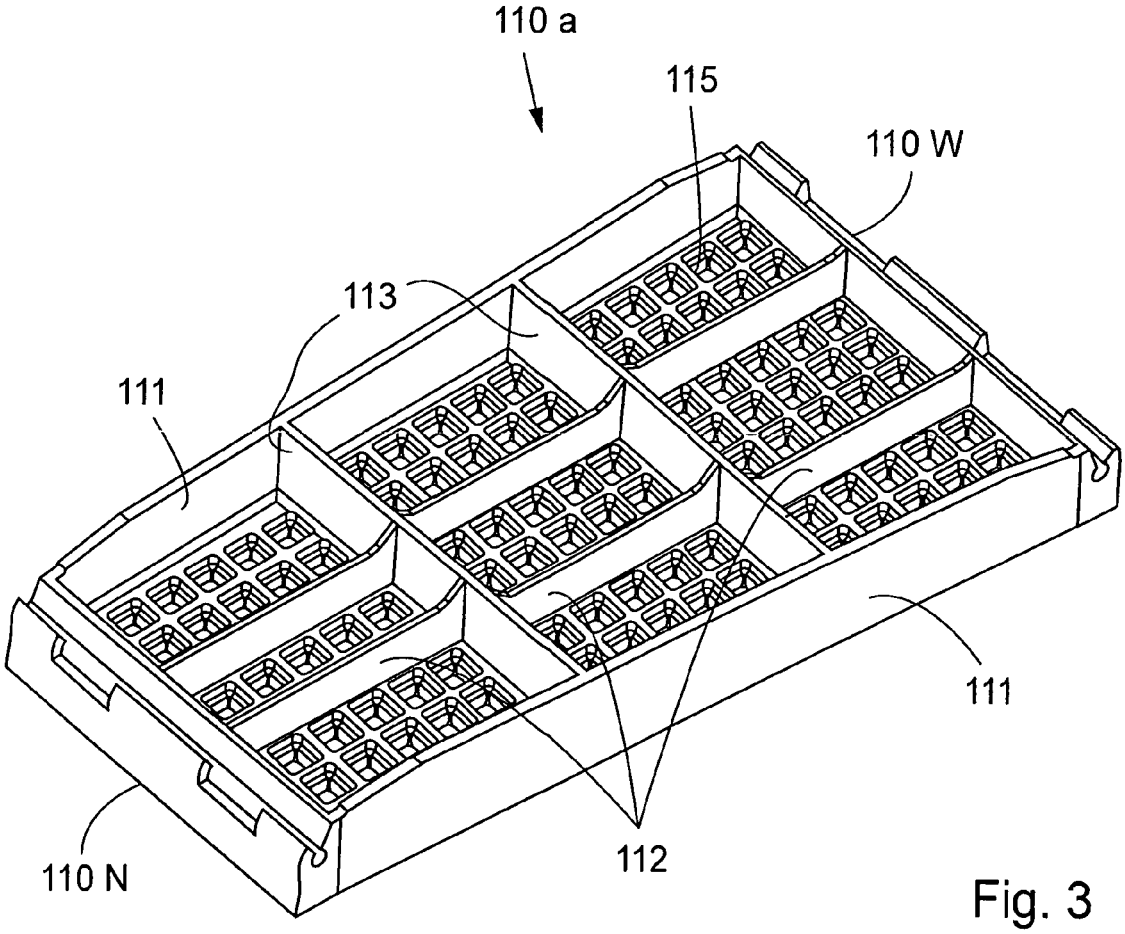
FIG. 3 is a perspective view showing the underside of a screening element according to the present invention.

In FIG. 3, an underside of a screening element 110*a*, 110*b* is shown. As can be seen, the screening element comprises a framework 111, including both longitudinal frame portions 112 and transversal frame portions 113. The screening membrane 115 is provided between the frame portions 111, 112 and 113.

Figure 4A:
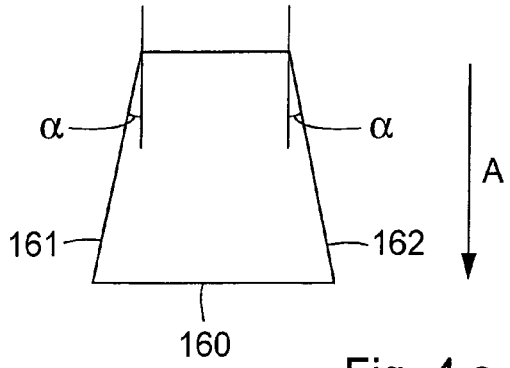
FIGS. 4*a*-4*d* are simple plan views of respective alternative embodiments of screening elements according to the present invention.
Figure 4B:
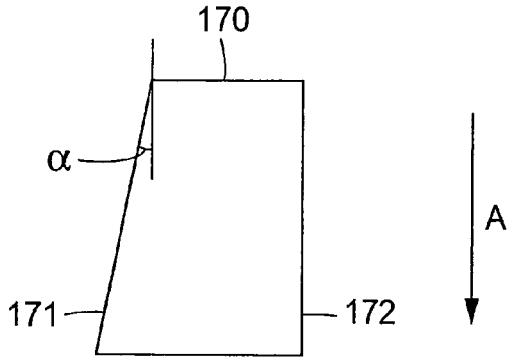

Four embodiments 160, 170, 180 and 190 of the screening element according to the present invention are shown in FIGS. 4*a*-4*b*, respectively. The screening element 160, which is shown in FIG. 4*a*, is similar to the screening element shown in FIGS. 1-3. The screening element 160 has two sides 161, 162 that are not parallel with either the longitudinal direction A of the screening deck or the traveling direction of the material. The sides deviate at an angle $\alpha$ from the longitudinal direction A. The angle $\alpha$ should be in the range of 1 and 45 degrees, more preferably in the range of 1 and 15 degrees. The angles have an effect on the traveling of material that will be discussed later.

The screening element 170, shown in FIG. 4*b*, has one side 172 parallel with the longitudinal direction A, and has one side 171 that is not parallel with the longitudinal direction A.

Figure 4C:
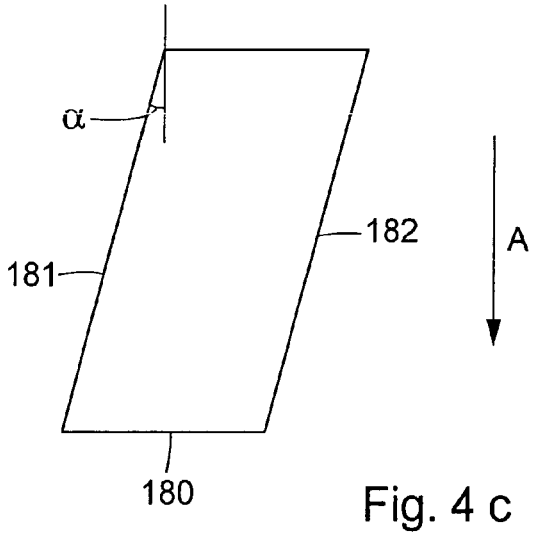

In FIG. 4*c*, a screening element 180 that has two sides 181, 182 that are not parallel with the longitudinal direction A is shown. The two sides 131, 182 are, however, parallel with each other.

Figure 4D:
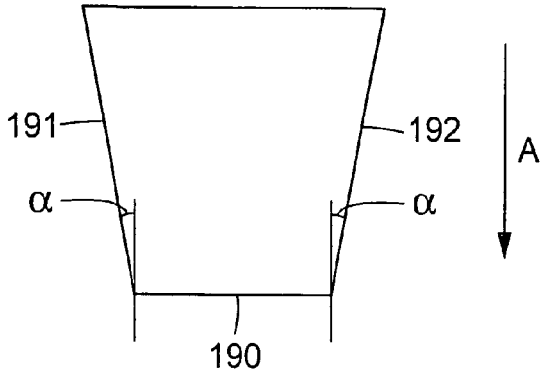

The screening element 190, shown in FIG. 4*d*, is rotated 180 degrees compared to the screening element 160. It has two sides 191, 192 that are not parallel with the longitudinal direction A of the screening deck or with the traveling direction of the material.

Figure 5:
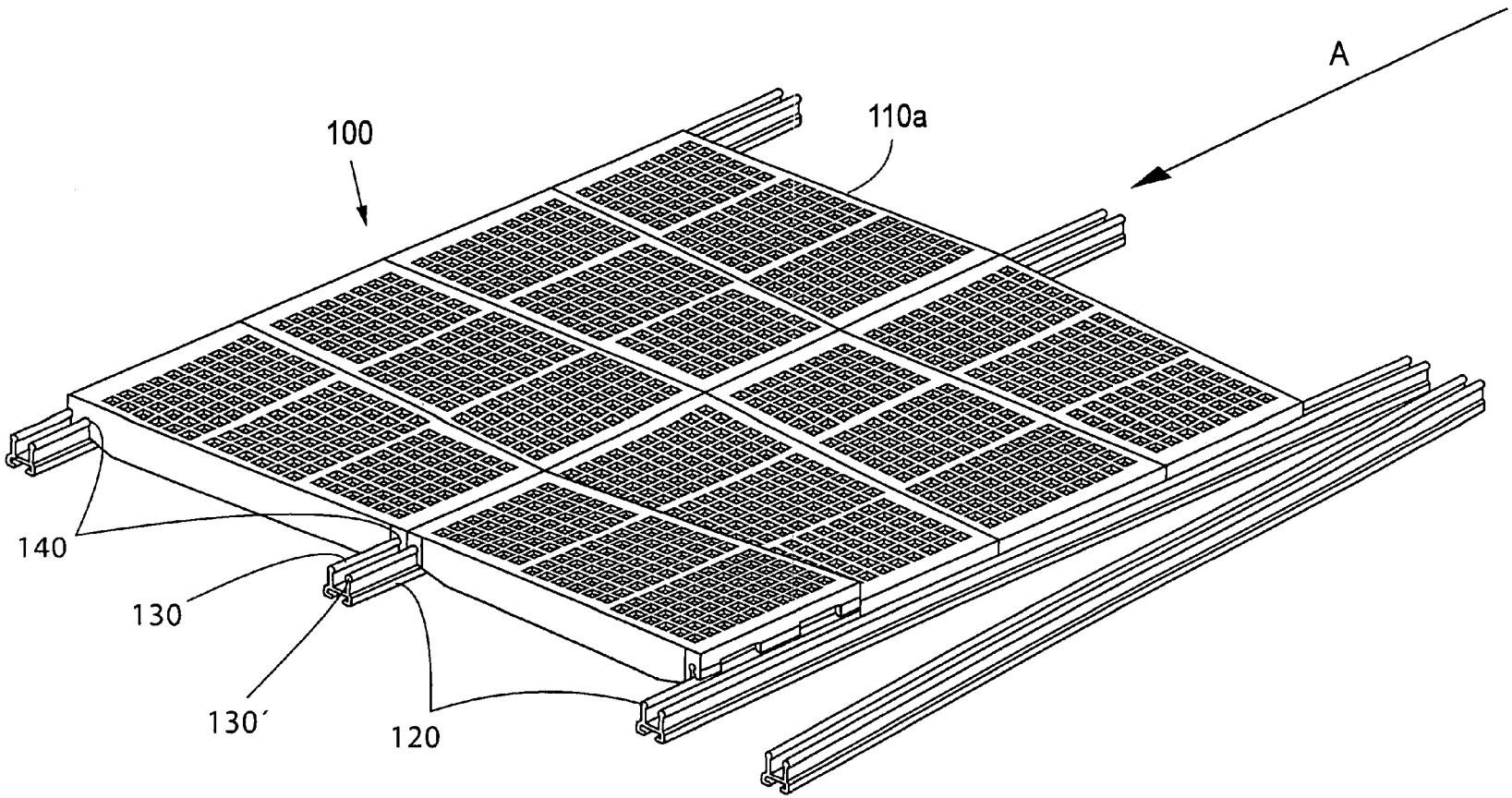
FIG. 5 is a schematic perspective assembly view of a screening deck with the screening elements arranged perpendicularly to the longitudinal direction of the screening deck.

In FIG. 5 an alternative orientation of the screening elements 110*a* on the screening deck 100 is shown. Alternatively, the screening element 110*b* could have been shown to demonstrate this. According to this embodiment, the carriers 120 are parallel with the longitudinal direction A of the screening deck 100. Only one type of screening element is used, i.e., all screening elements have the same height, creating a substantially flat screening deck 100. The screening elements 110*a* are alternately orientated so that a continuous screening deck 100 is created, and the screening elements 100*a* can be fastened to the carriers 120.

Figure 6:
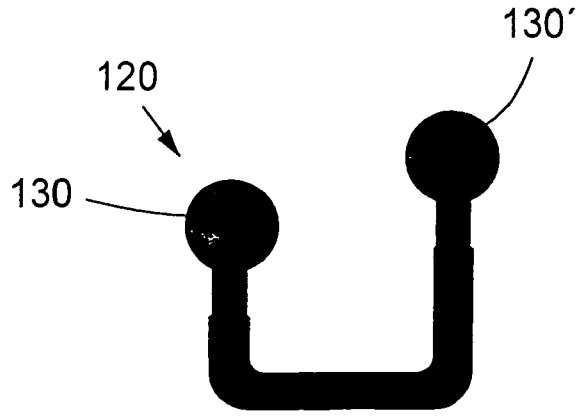
FIG. 6 is a section view of a first embodiment of a carrier in a screening deck according to the present invention.
Figure 7:
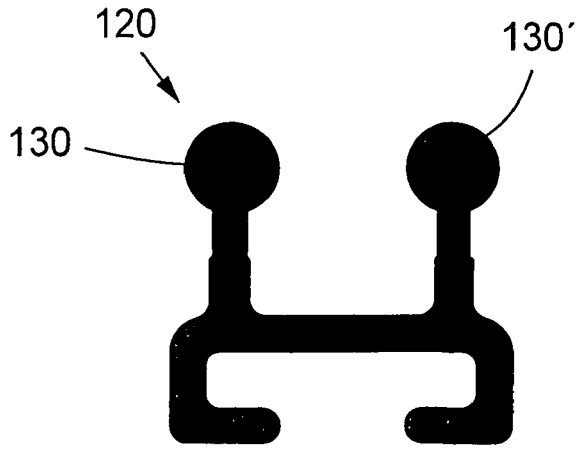
FIG. 7 is a section view of a second embodiment of a carrier in a screening deck according to the present invention.

In FIGS. 6 and 7, cross-sections of two respective embodiments of the carriers 120 are shown. According to the first embodiment, in FIG. 6, the stanchion 130 is lower than the stanchion 130', which together with the different heights of the screening elements 110*a*, 110*b* results in "steps" (i.e., adjacent portions of different elevations) being formed on the screening deck 100, as indicated by the arrow B in FIG. 1. According to the second embodiment, shown in FIG. 7, the stanchions 130, 130' have the same height, which results in a flat screening deck 100, shown in FIG. 5, provided that the height of the screening elements 110*e*, 110*b*, as measured from the snap lock 140 to the screening membrane 115, does not differ.

Figure 8:
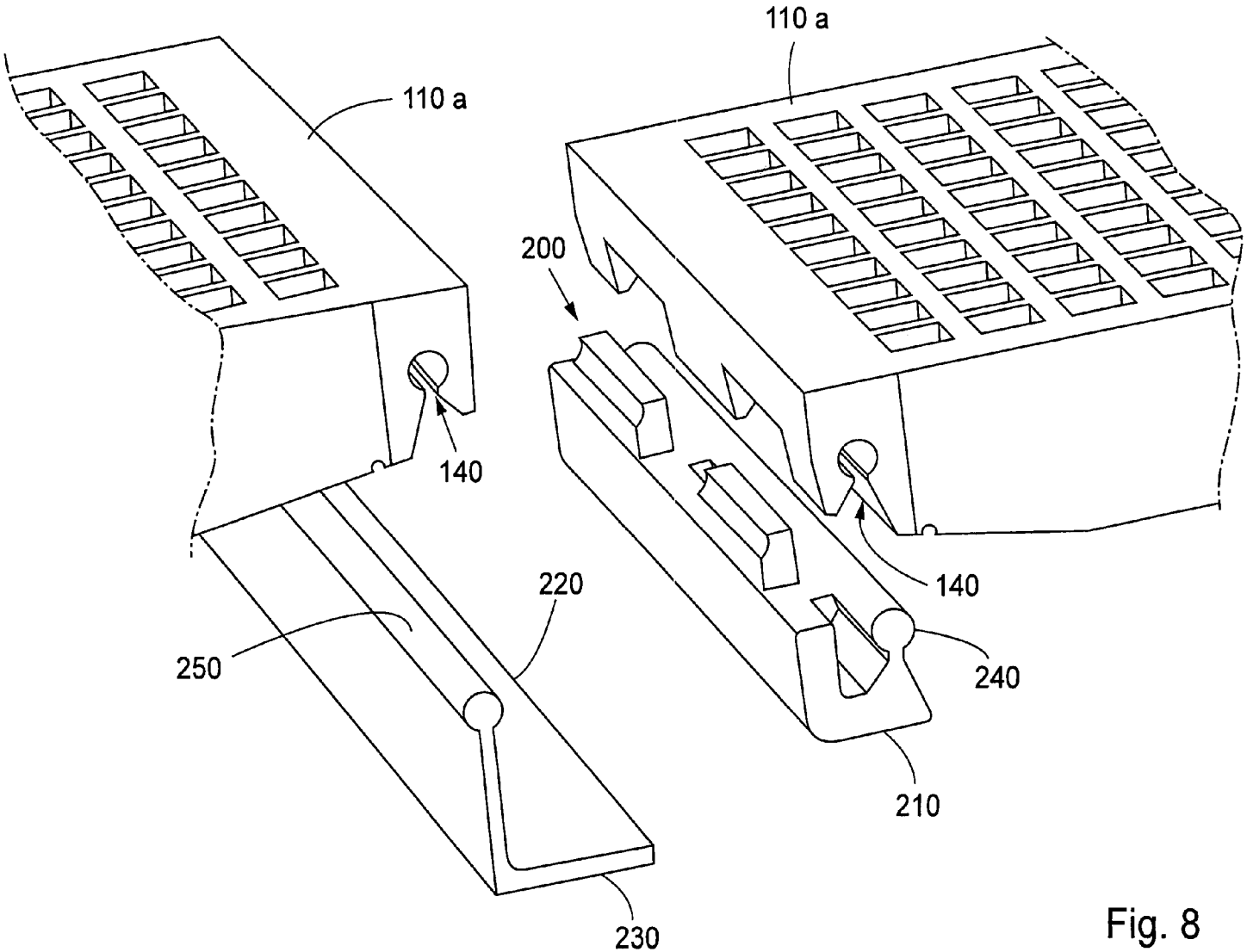
FIG. 8 is a perspective assembly view specifically illustrating an adapter for enabling a screening element according to the present invention to be used in a conventional screening deck assembly.

In FIG. 8, an adapter 200 is shown for fitting a screening element 110*a* according to the present invention to a prior art assembly according to SE-A-C 460 340. The adapter 200 comprises a lower surface 210 for interaction with a shelf 220 of a prior art carrier 230. The adapter further comprises a stanchion 240 for interaction with the snap locks 140 of the screening elements 110*a* according to the present invention. During operation, the adapter 200 is kept in its place by a force exerted by a screening element fastened on the stanchion 240, since the screening element is fastened to a stanchion 250 in its other end.

In practice, the carriers 120 are fastened by bolting, welding or other suitable fastening means to support beams (not shown) arranged in a vibrating screen. The screening elements 110*a*, 110*b* are fastened to the elongated stanchions 130, 130' with the snap locks 140. The combination of screening elements 110*a*, 110*b* being fastened on the stanchions results in a screening deck 100. Even though the shown embodiments include the feature of fastening both ends of the screening elements 110*a*, it would be possible to fasten only one end of the screening element. Likewise, the invention has only been shown with the snap locking method for fastening the screening element as it provides flexible fastening means, but other means of fastening are also possible, e.g., bolting, screwing, jamming or clamping.

As implied in FIGS. 1-3 and 5, but clearly shown in FIGS. 4*a*-4*c*, the screening elements 110*a*, 110*b* according to the present invention in most cases have a non-rectangular shape seen from above, i.e., the screening elements have one narrow end 110N and one wide end 110W. The screening element 180 in FIG. 4*c* differs from this by having two ends with the same width. As earlier stated, the screening elements 110*a*, 110*b* are alternately fastened on the carriers 120, i.e., one wide end 110W of one screening element 110*a*, 110*b* is neighbored by two narrow ends 110N of the neighboring screening elements 110*a*, 110*b*. By this arrangement, the sides of the adjacent screening elements do not form any straight paths from one end of the screening deck 100 to the other end of the screening deck 100 parallel to the travel path, which minimizes the risk that stones or gravel may travel all the way from one end of the screening deck 100 to the other end of the screening deck 100 without encountering a hole H.

As is well known to people skilled in the art of screening, a screening membrane is provided with holes H having varying respective sizes and shapes to fractionate crushed stone into different-size fractions of stones or gravel. According to the invention, the holes H are also arranged with a transversal displacement so that the stones or gravel cannot travel in the longitudinal direction of the screening deck without encountering a screening hole. As shown in, e.g., FIG. 2, the holes H could be grouped in different groups H1-H3 as the width of the screenings element varies. In FIG. 2 the holes are mutually parallel, having a greater density of holes in the group of holes H1 located close to the wide end 110W of the screening element 110*a*, than in the group of holes H3 located close to the narrow end 110N. FIG. 2 further shows that the holes of each of the groups H1-H3 are displaced (offset) in relation to the holes of the next group in the direction of travel and in relation to the longitudinal direction A of the screening deck. Every row of holes H could be transversely displaced in relation to the most of the other rows (not shown), and not merely transversely displaced in relation to other groups of rows of holes H as shown in FIG. 2.

As mentioned above, the angle $\alpha$ can vary in the range of 1 and 45 degrees. It is preferable to have a relatively large angle $\alpha$, since with increasing angle $\alpha$ the traveling speed of the stones and the gravel over the screening deck is reduced, and the likelihood for a stone or piece of gravel to fall into the screening holes is thereby increased. A larger angle $\alpha$, however, causes a larger wear on the screen element, necessitating that the screen elements be replaced more often. The preferred angle $\alpha$ is therefore between 1 and 15 degrees.

The size of the screening elements can vary, but is adapted to fit as many vibration screens as possible. To facilitate the assembly of the screening decks the different screening elements 110*a*, 110*b* with different heights can be colored differently, e.g., grey for the screening element 110*a* and blue for the screening element 110*b*.

The preferred material of the screening elements is polyurethane (PU) or rubber. In a preferred embodiment, the framework 111, 112, 113 is manufactured from relatively unresilient PU, whereas the screening membrane 115 of the screening element 110*a*, 110*b* is manufactured of a more resilient PU. The preferred materials for the framework 111, 112, 113 have a hardness that preferably is in the range from about 90 Shore A to about 75 Shore D, and the preferred materials for the screening membrane have a hardness of about 30 Shore A to about 95 Shore A or, more preferred, from about 40 Shore A to about 80 Shore A.

Preferred materials are, e.g., PU, metal, rubber, PVC, polyethylene, polyamide, polyester or the like for the framework 111, 112, 213 and urethane rubber, suitable natural rubber compounds or other rubber materials for the screening membrane. The invention is, however, not limited to screening elements without a separate framework, but also applies to screening elements with a frame like prior art screening elements.

The height of the stanchions 130, 130' can, as mentioned, be varied. By having a larger height difference between the stanchions 130, 130', the step height between each row of screening elements increases. The difference in stanchion height corresponds to the step height B, shown in FIG. 1, on the screening deck 100.

As an alternative to the embodiment in FIG. 1, every screening element can be shaped as if rotated 180 degrees in the vertical plane whereby the narrow end of the screening element 110*a* would be located upstream and the wide end located down-stream. The screening elements 110*b* would have the wide end located upstream and the narrow end located downstream. This provides a screening deck, where material from the screening element 110*b* will fall down to screening element 110*a* and create turbulence in the material. The screening element 110*a* will alter the direction of the material much less due to the widening shape. It is, however, possible for the material membrane to be slightly thinned out since the screening element is widening along the traveling direction.

In the foregoing it has been described that the non-flat structure of the screening deck, i.e., the steps and difference in level, is provided by screening elements of different height and by stanchions of different height, but it could of course be provided in other ways as well.

The invention should not be limited to the shown embodiment; modifications within the scope of the appended claims are possible. For example, there could be used more than two types of different-height screening elements.

What is claimed is:

1. A screening deck for the screening of crushed stone material, comprising a plurality of screening elements arranged adjacent one another and forming an upper screening surface which defines a longitudinal direction in which the material travels; each screening element including multiple sides including two opposing ends and two opposing sides, each of the two opposing sides being arranged such that one end thereof is spaced from the other end in the longitudinal direction; at least one of said two opposing sides extending non-parallel to the longitudinal direction; the screening elements further including first and second screening elements of different respective heights arranged to create different elevations in the screening surface, and wherein at least one non-parallel side of the first screening elements is arranged to be in direct contact along the entire length of at least one non-parallel side of at least one of the second screening elements transversely adjacent to the first screening element.

2. The screening deck according to claim 1, wherein both of said two opposing sides of each screening element are non-parallel with the longitudinal direction.

3. A screening deck according to claim 2, wherein the different-height screening elements are arranged alternately in the longitudinal direction.

4. A screening deck according to claim 3, wherein the different-height screening elements are arranged alternately in a transverse direction oriented transversely of the longitudinal direction.

5. A screening deck according to claim 1, wherein the different-height screening elements are arranged alternately in the longitudinal direction.

6. A screening deck according to claim 1, wherein the different-height screening elements are arranged alternately in a transverse direction oriented transversely of the longitudinal direction.

7. A screening deck according to claim 1, further comprising carriers for supporting the screening elements, each screening element provided with fastening structure configured to be fastened to the carriers.

8. The screening deck according to claim 7, wherein the carriers are provided with elongated stanchions to which are fastened ends of the screening elements, both ends of each screening element including a snap lock structure interacting with the stanchions.

9. The screening deck according to claim 8, wherein the elongated stanchions form, together with the different-height screening elements, steps spaced apart along the longitudinal direction of the screening deck.

10. The screening deck according to claim 1, wherein each screening element includes a framework supporting a screening membrane.

11. The screening deck according to claim 10, wherein the framework and the screening membrane comprise polyurethane.

12. The screening deck according to claim 11, wherein the framework and the screening membrane comprise polyurethane of different respective hardnesses.

13. The screening deck according to claim 7, wherein the carriers are arranged transversely of the longitudinal direction.

14. The screening deck according to claim 7, wherein the carriers are oriented parallel to the longitudinal direction.

15. The screening deck according to claim 1, further comprising carriers for supporting the screening elements, each carrier including a stanchion and one shelf extending therefrom, and further comprising an adapter provided with a stanchion interacting with snap locks on one end of the screening element.

16. The screening deck according to claim 1, wherein the screening elements include holes, and wherein the holes are arranged with a transversal displacement.

17. The screening deck according to claim 16, wherein the transversal displacement is between groups of holes.

18. The screening deck according to claim 1, wherein the screening elements include holes, and wherein the holes are mutually parallel and have a first density of holes in a first portion closest to a wide end of the screening element that is greater than a second density of holes in a second portion closest to a narrow end of the screening element.

19. The screening deck according to claim 1, wherein each of two of the opposing ends being arranged such that one end thereof is spaced from the other end in the transverse direction.

20. The screening deck according to claim 1, wherein the upper screening surface in each of the plurality of screening elements defines a plane, wherein each of two of the opposing sides of the screening element and each of two of the opposing ends of the screening element circumscribe the plane, and wherein one of the two opposing ends has a shorter distance in a direction transverse to the direction in which the material travels than a second of the two opposing ends.

21. The screening deck according to claim 1, wherein at least one parallel side for one screening element is adjacent at least one non-parallel side for another of the plurality of screening elements.

22. The screening deck according to claim 1, wherein the arrangement of screening elements at different heights having at least one non-parallel side creates narrowing passages or winding paths for the material on the screening deck.

23. The screening deck according to claim 1, wherein at least one screening element is at a lower height than at least two adjacent screening elements.

* * * * *